US006431737B1

(12) United States Patent
Oyama et al.

(10) Patent No.: US 6,431,737 B1
(45) Date of Patent: Aug. 13, 2002

(54) VEHICLE HEADLAMP HAVING MULTI-REFLEX OPTICAL SYSTEM

(75) Inventors: Hiroo Oyama, Sagamihara; Yoshifumi Kawaguchi; Takashi Akutagawa, both of Kawasaki, all of (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 09/534,013

(22) Filed: Mar. 24, 2000

(30) Foreign Application Priority Data

Mar. 25, 1999 (JP) ..... 11-082056

(51) Int. Cl.[7] ..... F21V 7/09

(52) U.S. Cl. ..... 362/516; 362/517; 362/519; 362/247; 362/297; 362/346

(58) Field of Search ..... 362/16, 135, 509, 362/516, 517, 519, 235, 247, 248, 296, 297, 298, 310, 341, 346, 358, 359; 359/546, 850, 851, 853, 857, 858, 854, 838

(56) References Cited

U.S. PATENT DOCUMENTS 2,592,075 A * 4/1952 Smith ..... 313/114
2,647,203 A * 7/1953 Smith ..... 362/350
3,609,340 A * 9/1971 Habro ..... 362/303
4,918,580 A * 4/1990 Nino ..... 362/539

FOREIGN PATENT DOCUMENTS

JP 7-60613 6/1995
JP 2000-11718 1/2000

* cited by examiner

*Primary Examiner*—Sandra O'Shea
*Assistant Examiner*—Ismael Negron
(74) *Attorney, Agent, or Firm*—Morgan, Lewis & Bockius LLP

(57) ABSTRACT

A lamp having a multi-reflex optical system can include a first ellipse group reflector and a third ellipse group reflector each sharing one light source at a first focal point, with a second focal point of the first reflector being above its first focal point and a second focal point of the third reflector being positioned below its first focal point. A parabolic group second reflector can be positioned above the first reflector and can have a focal point located at the second focal point of the first reflector. A parabolic group fourth reflector can be positioned below the third reflector and can have a focus at the second focal point of the third reflector. Light from the light source that is converged by the ellipse group first reflector and third reflector is then supplied to the parabolic group second and fourth reflectors to provide a bright oblong headlamp.

20 Claims, 5 Drawing Sheets

VEHICLE HEADLAMP HAVING MULTI-REFLEX OPTICAL SYSTEM

This invention claims the benefit of Japanese Patent Application No. HEI 11-82056, filed on Mar. 25, 1999, which is hereby incorporated by reference.

BACKGROUND OF THE INVENTION

1. Field of the Invention

The invention relates to a lamp for use in the illumination of a headlamp, etc., and more particularly relates to a vehicle lamp forming a light distribution characteristic in a multi-reflex manner using an ellipse group reflector and a parabola group reflector.

2. Description of the Related Art

FIG. 8 shows an example configuration for a vehicle lamp fitting 90 for use in a conventional headlamp. Here, a light source 92 having a filament such as C-6 or C-8 type (an example of a C-6 type is shown in the FIG. 3) is positioned approximately at the focal point of a reflector 91 that includes a parabola group surface such as a rotated paraboloid, a parabolic surface, or a free-curved surface. The dimensions of such a reflector 91 are a width w of approximately 150 to 300 mm, and a height h of approximately 80 to 150 mm.

In the vehicle lamp fitting 90, when the C-6 type filament is used as the light source 92, it is difficult to prevent all unnecessary upwardly inclined light from being emitted toward the on-coming lane. In recent years it has therefore become common to adopt a C-8 type filament provided with a hood within a bulb (H-4 type) for preventing light from being directed toward the lower half of the reflector 91. However, in this case the vehicle lamp fitting 90 has a decreasing rate of utilization of the luminous flux due to the hood within the bulb.

It is important that the characteristics of the reflector 91 of the vehicle lamp fitting 90, such as the aspect ratio, etc., match with the design of the vehicle to which the vehicle lamp fitting 90 is to be attached. Accordingly, so-called oblong designs where the width w is smaller than the height h of the lamp may be required.

However, since a broad light distribution pattern in a widthwise direction is preferable in this type of vehicle lamp fitting, when the width w necessary for maintaining the preferred amount of light in the horizontal direction is narrowed, the amount of light emitted by the vehicle lamp noticeably decreases. For example, when the width w is narrowed to approximately 50 mm, only half the amount of light as compared to the related art is obtained, and the remaining light cannot be put to practical use.

In particular, when a C-8 type filament is used as the light source 92 and the width of the vehicle lamp fitting is narrowed, the hood no longer functions properly. The loss of light due to the decrease in the width of the lamp is not consistent with and deteriorates the function of the hood, which is provided to prevent upwardly inclined light from being emitted from the vehicle lamp. As a result, the light distribution and amount of light produced by the lamp deteriorate. In all of the above mentioned cases, an oblong design cannot be implemented without causing serious deterioration of the light quality of the lamp, which in turn puts limitations on the design of the vehicle body.

SUMMARY OF THE INVENTION

In order to resolve the aforementioned problems in the related art, the invention includes an oblong headlamp that has an ellipse group first reflector, a parabolic group second reflector, an ellipse group third reflector and a parabolic group fourth reflector. A light source can be located at a first focal point of the ellipse group first reflector. The parabolic group second reflector has a focal point located in the vicinity of a second focal point of the first reflector. The light source is also located at a first focal point of the ellipse group third reflector. The parabolic group fourth reflector has a focal point located in the vicinity of the second focal point of the third reflector. The second focal point of the first reflector is located above the first focal point and the second reflector is located above the first reflector. The second focal point of the third reflector is located below the first focal point, and the fourth reflector is located below the third reflector. The first reflector and third reflector share a light source at a respective first focal point.

An aperture can be provided in part of the first reflector and/or part of the third reflector, and a parabolic group fifth reflector can be provided for directing light that has been emitted from the light source and which has traveled through the aperture, in a direction of illumination of the oblong headlamp. In other words, light reflected by the fifth reflector in the illumination direction of the vehicle lamp originated from the light source and passed through the aperture in the first reflector.

The third reflector can also be divided into a front third reflector and a rear third reflector and the fourth reflector can be divided into a front fourth reflector and a rear fourth reflector. The front third reflector mainly directs light going downwards and forwards from the light source toward the rear fourth reflector, and the rear third reflector mainly directs light going downwards and forwards from the light source toward the front fourth reflector. The rear third reflector and front fourth reflector mainly direct light toward an illumination direction of the oblong headlamp.

The invention can include only the upper half (i.e. the first and second reflectors) or the lower half (i.e. the third and fourth reflectors) of the aforementioned oblong headlamp.

DESCRIPTION OF THE PREFERRED EMBODIMENTS

Figure 1:
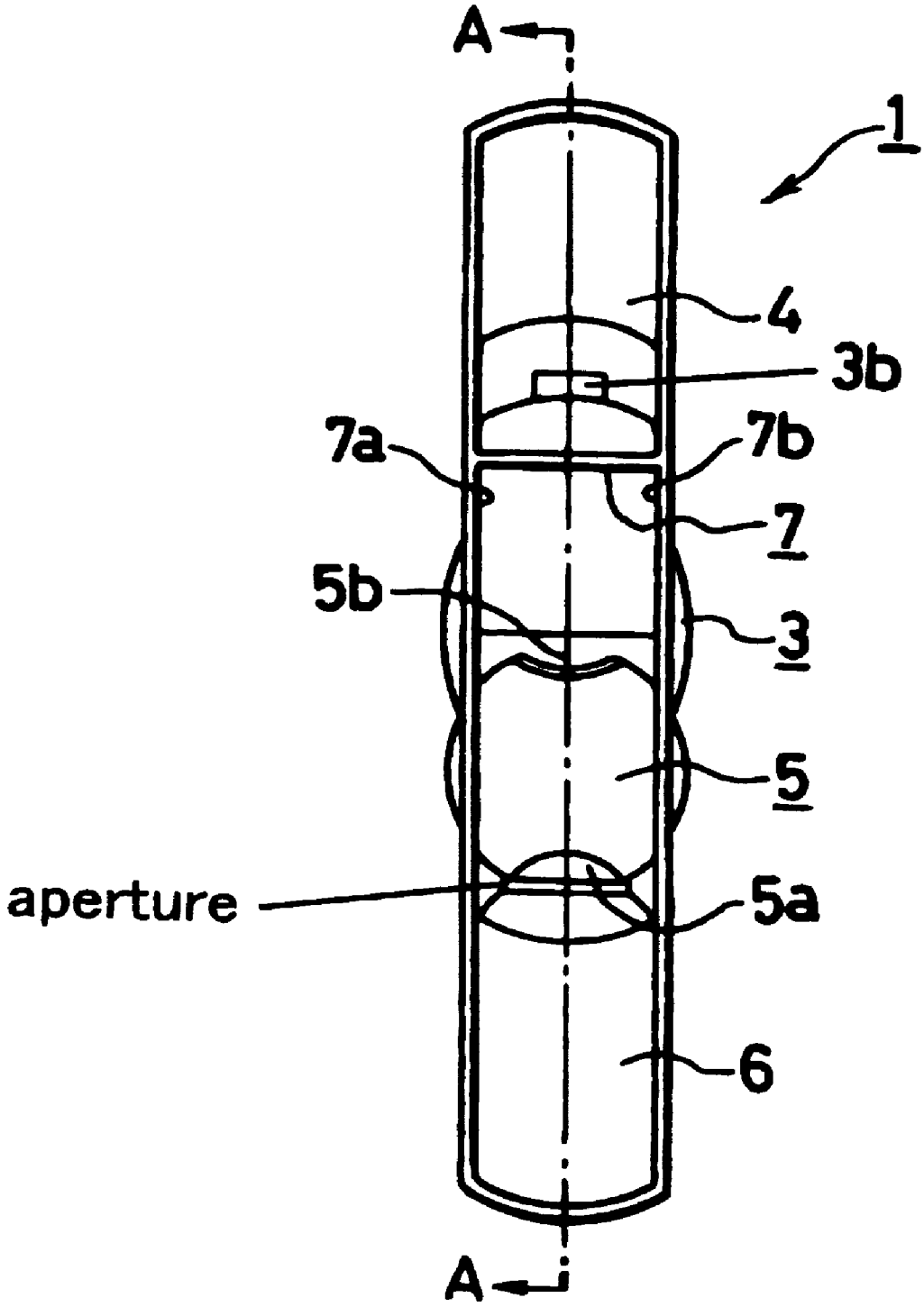
FIG. 1 is a front partial view of an embodiment of an oblong headlamp of the invention.
Figure 2:
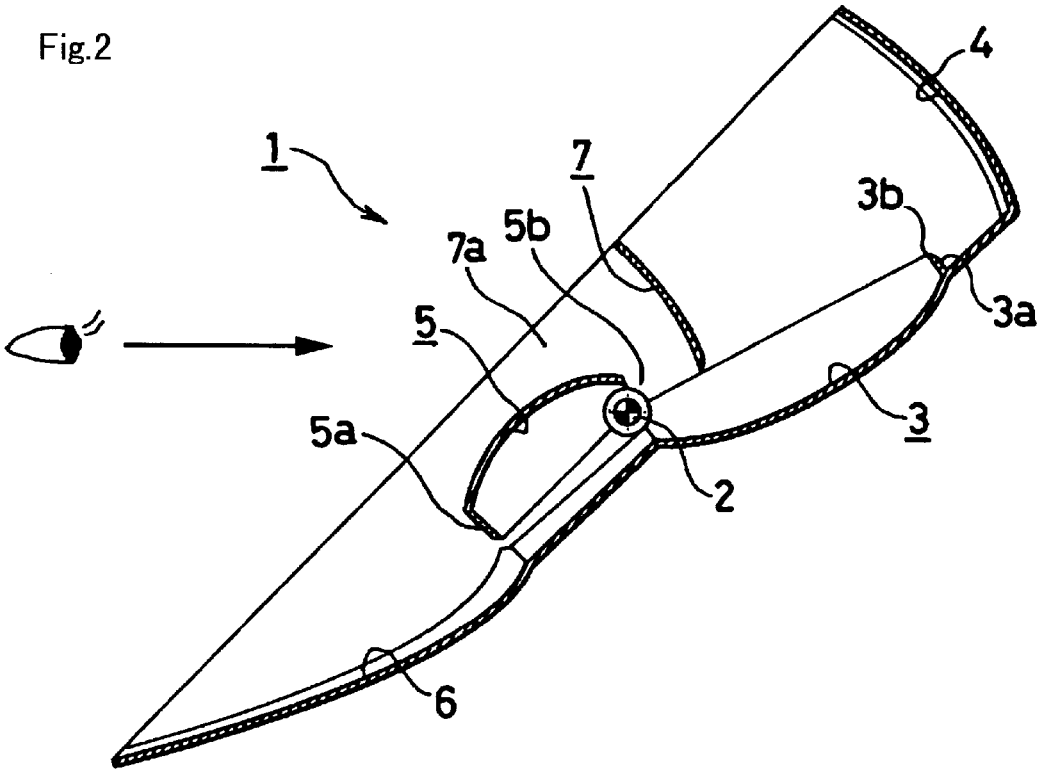
FIG. 2 is a cross-section view taken along line A—A of FIG. 1.

A detailed description of the invention will now be given based on embodiments shown in the drawings. FIGS. 1 and 2 show an embodiment of an oblong headlamp 1 of the invention. FIG. 1 is a front view of the oblong headlamp 1 as viewed from a direction as shown by an arrow in FIG. 2.

The front outer shape of the oblong headlamp 1 substantially corresponds to a vehicle's body shape at a location where the oblong headlamp 1 is disposed. The oblong headlamp 1 can include a light source 2, a first reflector 3, a second reflector 4, a third reflector 5, a fourth reflector 6 and a fifth reflector 7. Other portions of the lamp, such as the lens, can be similar to those usually provided for this type of lamp configuration. A detailed description of the other various components of the lamp is omitted here in order to avoid complicating the description.

The first reflector 3 can be an ellipse group reflector such as a rotated ellipsoid having two focal points, with the light source 2 located at the first focal point. The second reflector 4 can be a parabolic group reflector such as a rotated paraboloid having one focal point. The focal point of the second reflector 4 can be arranged in the vicinity of the second focal point of the first reflector 3. Further, the second focal point of the first reflector 3 is preferably arranged above its first focal point and the second reflector 4 is preferably arranged above the first reflector 3.

The third reflector 5 can be an ellipse group reflector with the light source 2 located at the first focal point, and the fourth reflector 6 can be a parabolic group reflector with the focal point arranged close to the second focal point of the third reflector 5. Further, the second focal point of the third reflector 5 can be arranged below the first focal point, and the fourth reflector 6 can be arranged below the third reflector 5.

The first reflector 3 is preferably provided to the rear of the light source 2 relative to the direction of illumination of the oblong headlamp 1, and the third reflector 5 is preferably provided in front of the light source 2 relative to the direction of illumination of the oblong headlamp 1. Shades 3*a* and 5*a* can be provided in the vicinity of the second focal points of the first reflector 3 and the third reflector 5, respectively. Further, an aperture 5*b* can be provided in part of the third reflector 5. The fifth reflector 7, which can have a parabola group surface with the light source 2 located at a focal point, is provided in a range of locations where it reflects light that has been emitted from the light source 2 and that has passed through the aperture 5*b*.

Figure 3:
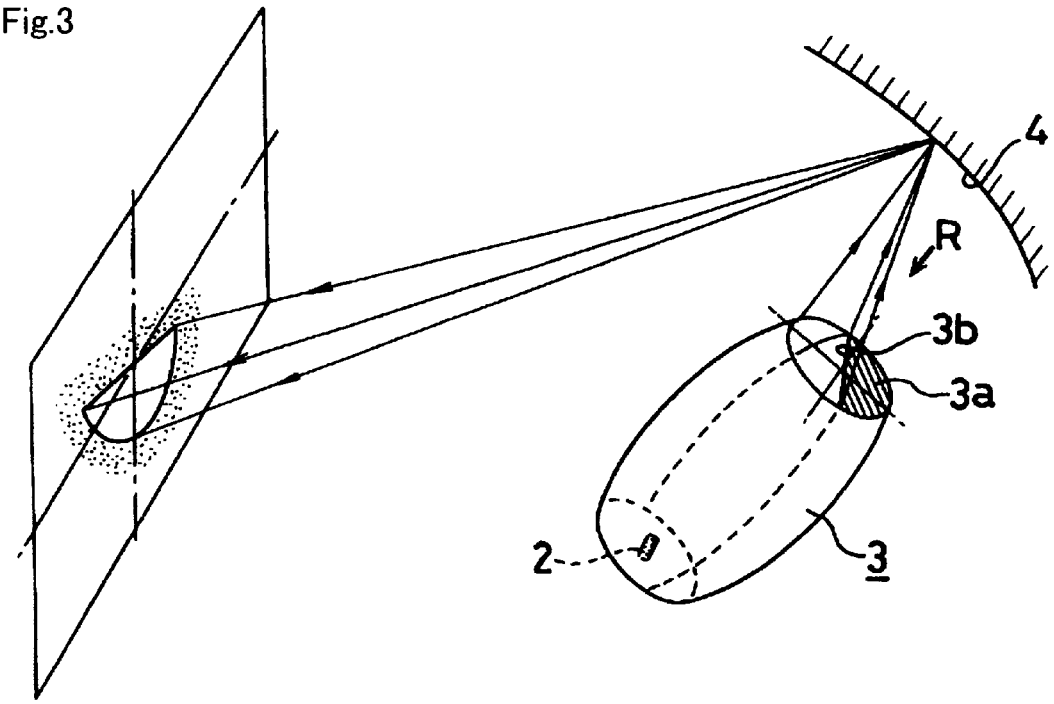
FIG. 3 is an illustration of positional relationships among parts of an oblong headlamp of the invention.

Next, principles of the light distribution characteristics for the oblong headlamp 1 configured as described above according to the invention will now be described based on FIGS. 3–5. FIG. 3 is a schematic view showing an arrangement for each part of the oblong headlamp 1 of the invention. The example of FIG. 3 includes a first reflector 3 and the second reflector 4 which are combined.

The light source 2 includes a filament such as a C-6 type filament arranged at the first focal point of the ellipse group first reflector 3. The light source 2 forms an image at the position of the second focal point f2 of the first reflector 3. The second reflector 4 is a parabolic group reflector having a focal point f3 in the vicinity of the second focal point f2 of the first reflector 3. The image of the light source 2 formed at the second focal point f2 is therefore projected in the direction of illumination of the oblong headlamp 1.

Figure 4:
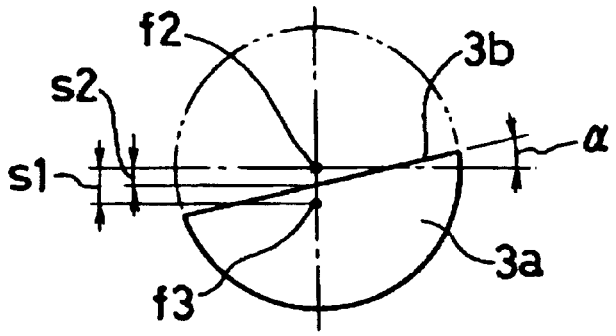
FIG. 4 is an illustration of the shading arrangement produced by an oblong headlamp of the invention.

FIG. 4 shows positional relationships of the second focal point f2 of the first reflector 3, the focal point f3 of the second reflector 4, and the shade 3*a*. In FIG. 4, the shade 3*a* is provided in the vicinity of the second focal point f2 of the first reflector 3 as viewed in the direction of arrow R in FIG. 3. The first reflector 3 is located along a periphery of an imaginary rotated ellipsoid, and the light source 2 is located at a first focus of the ellipse and also at a center point of a circular cross section perpendicular to a longitudinal axis of the rotated ellipsoid. The arrow R is located along a direction perpendicular to a longitudinal axis of the imaginary rotated ellipsoid.

An offset amount S1 is a distance between the second focal point f2 of the first reflector 3 and the focal point f3 of the second reflector 4. Positions of the second focal point f2 of the first reflector 3 and the focal point f3 of the second reflector 4 are determined when the basic entire shape of the first and second reflectors 3 and 4 are designed. An edge portion 3*b* of the shade 3*a* is offset by an amount s2 in the same direction as the focal point f3 with respect to the second focal point f2. At this time, the edge portion 3*b* can be simultaneously rotated counterclockwise to set the upper right of the edge portion 3*b* at an appropriate angle as shown in FIG. 4 such that the following relationship is satisfied: (offset amount s1)>(offset amount s2).

Figure 5:
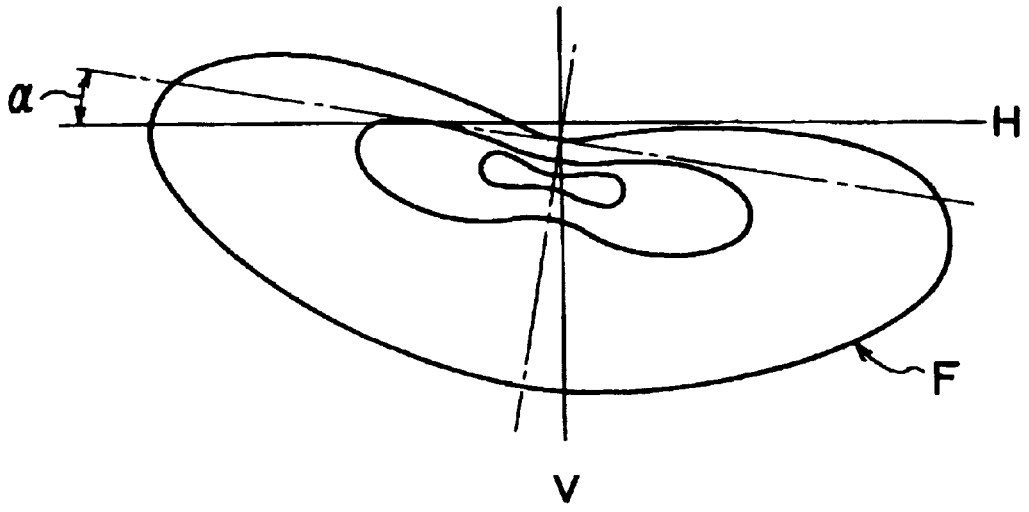
FIG. 5 is an illustration of the image of light projected by an oblong headlamp of the invention.

FIG. 5 shows the contour of light rays projected in the direction of illumination from the second reflector 4 when the above relationship between the second focal point f2, the focal point f3 and the edge 3*b* is satisfied. The lower half of the light rays from the first reflector 3 is partially blocked by shade 3*a* so that the light rays form a substantially semi-circular cross-section and are emitted towards and reach the second reflector 4. The second reflector 4 inverts the image of the light rays such that the upper and lower parts and left and right parts of the light rays are respectively reversed, and are projected forward of the oblong headlamp 1.

A parabolic group second reflector 4 can reflect the light from the C-6 type filament light source 2 such that the projected image of light rays forms a shallow V. Therefore, the projected image of the light rays that pass around the edge portion 3*b* form a shallow V portion to create the light distribution pattern F of the oblong headlamp 1. Because the edge 3*b* is inclined to the upper right by the angle $\alpha$, the projected image F of light projected in the direction of illumination is inclined to the upper left.

As shown in FIG. 5, if the right upper end of the projected image F is arranged such that it is substantially horizontal at the right side of a vertical central line V of the light distribution pattern of the oblong headlamp 1, an appropriately rounded-off upward light appears to the left side of the central line V such that an optimum light distribution pattern can be obtained for a headlamp for left-hand drive use.

Conversely, if the left upper end of the projected image F is tilted such that it is substantially horizontal at the left side of a vertical central line V of the light distribution pattern of the oblong headlamp 1, an optimum distribution pattern for right-hand drive use can be obtained.

In the embodiment of FIGS. 1 and 2, the edge portion 3*b* is formed as a straight line. However, it should be understood that the edge portion 3*b* can also be formed as a curved line or a broken line while still forming the desired predetermined light distribution patterns.

In the above description, an example is given where the first reflector 3 and the second reflector 4 are combined. The operation and results are substantially the same when the third reflector 5 and the fourth reflector 6 are combined. Accordingly, a detailed description of this combination is therefore omitted. However, in the combination of the third reflector 5 and the fourth reflector 6, the shade 5*a* can be provided instead of the aperture 5*b* for blocking direct light rays from the light source 2 from traveling to part of the fourth reflector 6 and thus preventing unnecessary upward light rays in the formation of the light distribution pattern.

An aperture 5*b* can be provided in part of the third reflector 5 as described above. The parabolic group fifth reflector 7 which can have an approximate focal point located at the light source 2 is provided in a range that is in the path of direct light that has been emitted from the light source and which has passed through the aperture 5*b* (refer to FIG. 2) such that substantially parallel light is projected in the direction of illumination.

The fifth reflector 7 can be a paraboloidal reflector that appears parabolic in a vertical cross-section and appears as a straight line in a horizontal cross-section. Side reflectors 7*a* and 7*b* (refer to FIGS. 1 and 2) can be configured as plane mirrors that are orthogonal with a straight line appearing at a horizontal cross-section of the paraboloidal reflector. In this configuration, it is possible to provide broader diffusion of light in the horizontal direction. It is also possible to provide only one of the reflectors 7*a* or 7*b* to achieve a similar effect.

As described above, according to the invention, light from the light source 2 is converged into a beam-shape by the ellipse group first reflector 3 and ellipse group third reflector 5. The converged light is directed in the illumination direction of the headlamp 1 by the parabolic group second reflector 4 and the parabolic group fourth reflector 6. Light loss can therefore be remarkably decreased compared with the related art even when a headlamp is oblong in shape.

Figure 6:
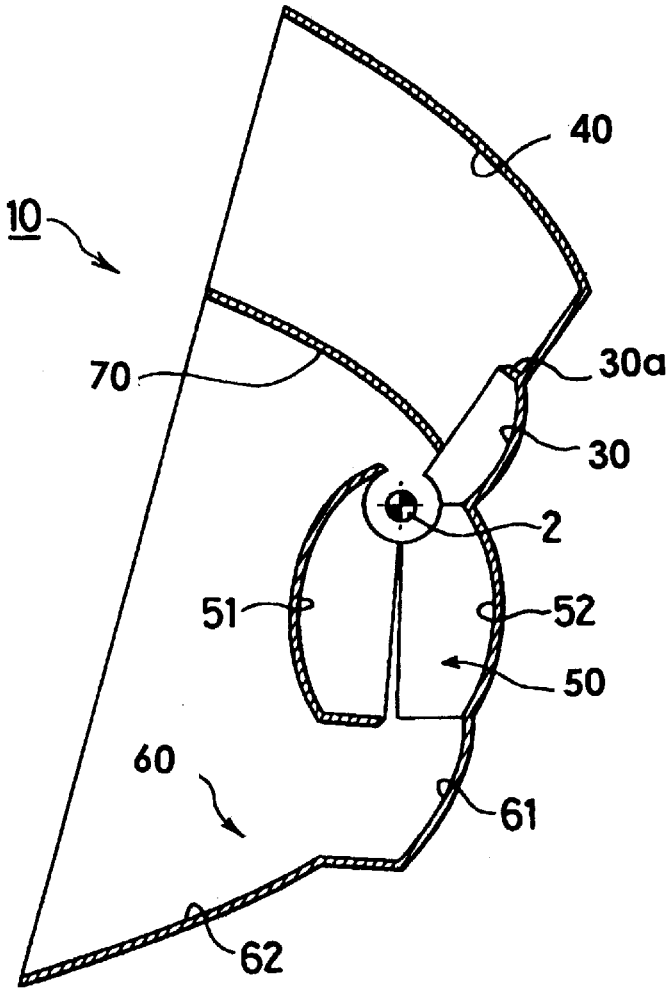
FIG. 6 is a partial cross-section view of another embodiment of an oblong headlamp of the invention.

FIG. 6 shows another embodiment of an oblong-type headlamp 10 of the invention. In the embodiment of FIG. 6, the configuration of the first reflector 30, second reflector 40 and fifth reflector 70 ate substantially the same as respective corresponding portions of the embodiment of FIGS. 1 and 2. A description thereof is therefore omitted, and points of distinction are described.

In the embodiment of FIGS. 1 and 2, the third reflector 5 and fourth reflector 6 can include a single curved surface. However, in the embodiment of FIG. 6, the third reflector 50 and fourth reflector 60 in the oblong headlamp 10 can both be comprised of two curved surfaces. In other words, the third reflector 50 is divided into a front third reflector 51 and a rear third reflector 52, and the fourth reflector 60 is divided into a rear fourth reflector 61 and a front fourth reflector 62.

The front third reflector 51 is provided towards the front of the lamp with respect to the light source 2 in the illumination direction of the headlamp 10, and mainly reflects light projecting downward and to the front from the light source 2. Reflected light from the front third reflector 51 is supplied to the rear fourth reflector 61 by substantially the same configuration as described above for the embodiment of FIGS. 1 and 2. The rear fourth reflector 61 reflects light in the illumination direction of the headlamp 10 in a manner similar to that of the embodiment of FIGS. 1 and 2.

The rear third reflector 52 is provided to the rear with respect to the illumination direction and with respect to the light source 2, the rear third reflector 52 mainly reflects light that is projected rearwards and downwards from the light source 2. Light reflected by the rear third reflector 52 is directed towards the front fourth reflector 62, and the front fourth reflector 62 then reflects this light in the illumination direction of the headlamp 10. According to the embodiment of FIG. 6, light projected downwards from the light source 2 can be captured and reflected in an extremely efficient manner, creating a more striking and brighter headlamp.

Figure 7:
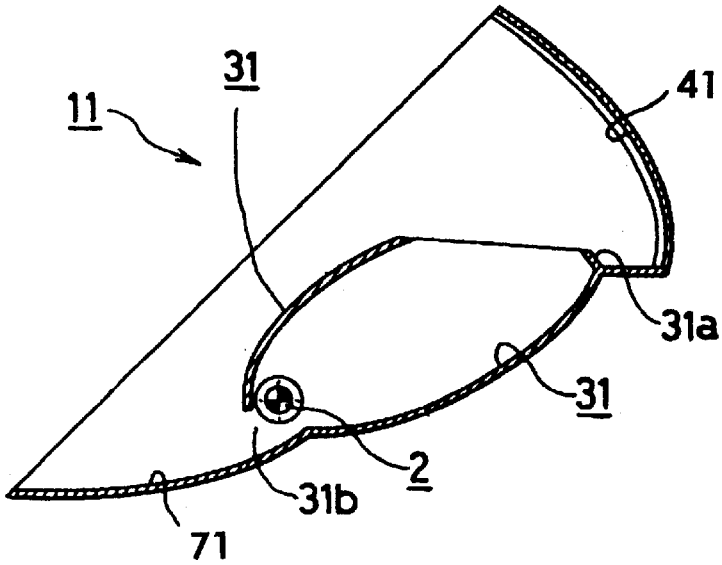
FIG. 7 is a partial cross-section of another embodiment of an oblong headlamp of the invention.
Figure 8:
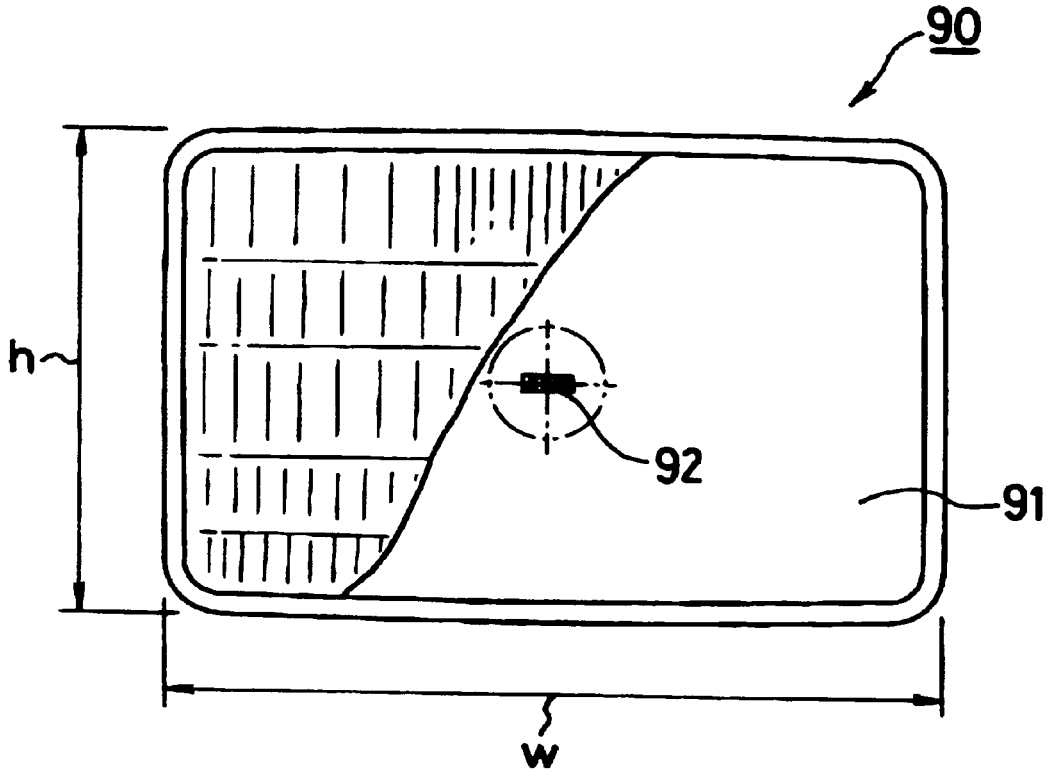
Fig.8 CONVENTIONAL ART
FIG. 8 is a front partially cut-away view of a related art lamp.

FIG. 7 shows another embodiment of the invention. As is clear from FIGS. 3–5 and their accompanying description, according to the invention, the oblong headlamp 11 can also include only the upper half of the configuration shown in FIG. 2, i.e., the first reflector 31 and the second reflector 41. However, in the embodiment of FIG. 7, the first reflector 31 is substantially a rotated ellipsoid and can be provided so as to substantially cover the periphery of the light source 2 around its end. The configuration of the first reflector 31 as shown in FIG. 7 is possible because it is no longer necessary for the light source 2 to supply light downwards.

The first reflector 31 therefore reflects more light from the light source 2 to the second reflector 41, and no noticeable reduction in the amount of light due to the configuration only including the first reflector 31 and the second reflector 41 occurs. The formation of light distribution patterns and the arrangement of the shade 31*a* can also be substantially exactly the same as described for the embodiment of FIGS. 1 and 2. An aperture 31*b* can be provided at the lower end of the first reflector 31, and the third reflector 71 may also be provided for reflecting the direct light from the light source 2 that passes through aperture 31*b*.

Although omitted from the drawings, the invention contemplates an embodiment including only a third reflector and a fourth reflector. While the embodiment as shown in FIG. 7 is formed substantially from just the upper half of the embodiment of FIGS. 1 and 2, an embodiment (not shown) is contemplated that includes only the lower half of the embodiment of FIGS. 1 and 2. In this case, the third reflector can be modified in the same manner as the first reflector 31 of the embodiment of FIG. 7.

As described above, the invention can include an oblong headlamp that has a first reflector and a third reflector constituted by two ellipse group reflectors that share one light source at a first focal point. A second focal point of the first reflector can be located above the first focal point and a second focal point of the third reflector can be positioned below the first focal point. A parabolic group second reflector can be arranged above the first reflector and can have a focal point at the second focal point of the first reflector. A parabolic group fourth reflector can be arranged below the third reflector and can include a focal point located at the second focal point of the third reflector. Light emitted from the light source that is converged by the first reflector and third reflector is then supplied to the parabolic group second and fourth reflectors so that even though the oblong headlamp may be required to have an extremely narrow width, e.g. 50 mm, such a headlamp can be implemented with the desired light distribution characteristic without a noticeable decrease in the quantity of light. The invention greatly enhances the possibilities for headlamp and vehicle design.

It will be apparent to those skilled in the art that various changes and modifications can be made herein without departing from the spirit and scope thereof. Thus, it is intended that the invention cover the modifications and variations of the embodiments of invention disclosed herein provided they come within the scope of the appended claims and their equivalents.

What is claimed is:

1. A lamp having a multi-reflex optical system, comprising:

an ellipse group first reflector having a first focal point and a second focal point, wherein the second focal point of the first reflector is located above the first focal point;

a parabolic group second reflector having a focal point located in the vicinity of said second focal point of said ellipse group first reflector, wherein the second reflector is located above the first reflector; and a light source located approximately at said first focal point of said ellipse group first reflector.

2. The lamp of claim 1, further comprising:

a shade located in the vicinity of the second focal point of the first reflector, said shade including an edge that gives a desired shape to a projected pattern of light reflected by the second reflector.

3. The lamp of claim 1, wherein an aperture is provided in a part of the first reflector.

4. The lamp of claim 1, wherein the lamp is a vehicle headlamp and is configured to be oblong in shape.

5. The lamp of claim 1, wherein an aperture is provided in a part of the first reflector, and the lamp further comprises a parabolic group third reflector that projects light that has been emitted from the light source and that has passed through said aperture, in an illumination direction of the lamp.

6. The lamp of claim 5, further comprising:

a side reflector provided at at least one side surface of the lamp around a portion corresponding to the third reflector, said side reflector configured to project light that has been emitted from the light source and which has passed through said aperture, in an illumination direction of the lamp.

7. A lamp having a multi-reflex optical system, comprising:

an ellipse group first reflector having a first focal point and a second focal point, wherein the second focal point of the first reflector is located below the first focal point;

a parabolic group second reflector having a focal point located in the vicinity of said second focal point of said ellipse group first reflector, wherein the second reflector is located below the first reflector; and a light source located approximately at said first focal point of said ellipse group first reflector; wherein an aperture is provided in a part of the first reflector, and the lamp further includes a parabolic group third reflector that projects light that has been emitted from the light source and that has passed through said aperture, in an illumination direction of the lamp.

8. The lamp of claim 7, further comprising:

a shade located in the vicinity of the second focal point of the first reflector, said shade including an edge that gives a desired shape to a projected pattern of light reflected by the second reflector.

9. The lamp of claim 7, wherein an aperture is provided in a part of the first reflector.

10. The lamp of claim 7, further comprising:

A side reflector provided at least one side surface of the lamp around a portion corresponding to the third reflector, said side reflector configured to project light that has been emitted from the light source and which has passed through said aperture, in an illumination direction of the lamp.

11. The lamp of claim 7, wherein the lamp is a vehicle headlamp and is configured to be oblong in shape.

12. A lamp, comprising:

an ellipse group first reflector with a first focal point and a second focal point;

a light source located at said first focal point of said first reflector;

a parabolic group second reflector, with a focal point located in the vicinity of said second focal point of the first reflector;

an ellipse group third reflector with a first focal point and a second focal point and said light source being located at said first focal point of the third reflector; and a parabolic group fourth reflector with a focal point located in the vicinity of the second focal point of the third reflector, wherein the second focal point of the first reflector is located above the first focal point of the first reflector, and the second reflector is located above the first reflector, the second focal point of the third reflector is located below the first focal point of the third reflector, and the fourth reflector is located below the third reflector, and the first reflector and third reflector share said light source.

13. The lamp of claim 12, further comprising:

a shade located in the vicinity of the second focal point of the first reflector, said shade including an edge that gives a desired shape to a projected pattern of light reflected by the second reflector.

14. The lamp of claim 12, wherein an aperture is provided in a part of the third reflector, and the lamp further comprises a parabolic group fifth reflector that projects light that has been emitted from the light source and that has passed through said aperture, in an illumination direction of the lamp.

15. The lamp of claim 12, wherein a primary aperture is provided in a part of the first reflector and a secondary aperture is provided in a part of the third reflector, and a parabolic group fifth reflector is provided for projecting light that has been emitted from the light source and that has been projected through the primary and secondary apertures, in an illumination direction of the lamp.

16. The lamp of claim 12, wherein the third reflector is divided into a front third reflector and a rear third reflector, and the fourth reflector is divided into a front fourth reflector and a rear fourth reflector, with the front third reflector and the front fourth reflector mainly reflecting light emitted in a downward and forward direction from the light source, and the rear third reflector and rear fourth reflector mainly reflecting light emitted in a downward and rearward direction from the light source.

17. The lamp of claim 12, wherein the lamp is a vehicle headlamp and is configures to be oblong in shape.

18. The lamp of claim 12, wherein an aperture is provided in a part of the first reflector.

19. The lamp of claim 18, further comprising:

a parabolic group fifth reflector configured to project light that has been emitted from the light source and which has passed through said aperture, in an illumination direction of the lamp.

20. The lamp of claim 19, further comprising:

a side reflector provided at at least one side surface of the lamp around a portion corresponding to the fifth reflector, said side reflector configured to project light that has been emitted from the light source and which has passed through said aperture, in an illumination direction of the lamp.

* * * * *